US006483491B1

(12) United States Patent
Lee

(10) Patent No.: US 6,483,491 B1
(45) Date of Patent: Nov. 19, 2002

(54) STRUCTURE AND DRIVING METHOD FOR PLASMA DISPLAY PANEL

(75) Inventor: Eun Cheol Lee, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 77 days.

(21) Appl. No.: 09/633,900

(22) Filed: Aug. 7, 2000

(30) Foreign Application Priority Data

Aug. 9, 1999 (KR) ..... 99-32641

(51) Int. Cl.[7] ..... G09G 3/28
(52) U.S. Cl. ..... 345/60; 345/67; 345/36
(58) Field of Search ..... 345/60, 67, 36, 345/37

(56) References Cited

U.S. PATENT DOCUMENTS 6,256,002 B1 * 7/2001 Shinoda ..... 345/60
6,262,700 B1 * 7/2001 Ueoka ..... 345/68
6,295,040 B1 * 9/2001 Nhan et al. ..... 345/60

* cited by examiner

*Primary Examiner*—Richard Hjerpe
*Assistant Examiner*—Kimnhung Nguyen
(74) *Attorney, Agent, or Firm*—Fleshner & Kim, LLP

(57) ABSTRACT

A structure and driving method for a plasma display panel is disclosed in which discharge efficiency is improved and service-life of phosphors is increased. The structure for a plasma display panel includes a plurality of upper electrodes formed on an upper substrate at certain intervals in one direction, a dielectric layer formed on the upper substrate including the upper electrodes, an auxiliary electrode formed on the dielectric layer between adjacent upper electrodes, a passivation film formed on the dielectric layer including the auxiliary electrode, a lower electrode formed on a lower substrate opposite to the upper electrodes to be orthogonal to the upper electrodes, and a dielectric layer formed on the lower substrate including the lower electrode. The driving method for a plasma display panel includes the steps of generating discharge by a first pulse applied to one electrode of the electrodes, and applying a second pulse to other electrode within 1 $\mu$m from the time when the first pulse is applied to the one electrode.

17 Claims, 10 Drawing Sheets

STRUCTURE AND DRIVING METHOD FOR PLASMA DISPLAY PANEL

BACKGROUND OF THE INVENTION

1. Field of the Invention

The present invention relates to a plasma display panel, and more particularly to a structure and driving method for a plasma display panel.

2. Discussion of the Related Art

Generally, a plasma display panel and a liquid crystal display (LCD) have lately attracted considerable attention as the most practical next generation display of flat panel displays. In particular, the plasma display panel has higher luminance and a wider viewing angle than the LCD. For this reason, the plasma display panel is widely used as a thin type large display such as an outdoor advertising tower, a wall TV and a theater display. The plasma display panel can be divided into a three-electrode type and a two-electrode type.

A related art plasma display panel of three-electrode area discharge type will be described with reference to the accompanying drawings.

As shown in FIG. 1*a*, the related art plasma display panel of three-electrode area discharge type includes an upper substrate 10 and a lower substrate 20 which face each other. In FIG. 1*b*, the lower substrate 20 is rotated by 90°.

The upper substrate 10 includes a plurality of scan electrodes 16 and 16', a plurality of sustain electrodes 17 and 17', a dielectric layer 11, and a passivation film 12. The scan electrodes 16 and 16' are formed at certain intervals in parallel to the sustain electrodes 17 and 17'. The dielectric layer 11 is deposited on the scan electrodes 16 and 16' and the sustain electrodes 17 and 17'.

The lower substrate 20 includes a plurality of address electrodes 22, a dielectric film 21 formed on an entire surface of the substrate including the address electrodes 22, a plurality of barriers 23 formed on the dielectric film 21 between the respective address electrodes, and a phosphor 24 formed on surfaces of the barriers 23 in each discharge cell and of the dielectric film 21.

Inert gases such as He and Xe are mixed in a space between the upper substrate 10 and the lower substrate 20 at a pressure of 400 to 500 Torr. The space forms a discharge region.

The scan electrodes 16 and 16' and the sustain electrodes 17 and 17' are of transparent electrodes and bus electrodes of metals so as to increase optical transmitivity of each discharge cell, as shown in FIGS. 2*a* and 2*b*. That is to say, the electrodes 16 and 17 are of transparent electrodes while the electrodes 16' and 17' are of bus electrodes.

FIG. 2*a* is a plane view of the sustain electrodes 17 and 17' and the scan electrodes 16 and 16', and FIG. 2*b* is a sectional view of the sustain electrodes 17 and 17' and the scan electrodes 16 and 16'.

A discharge voltage from an externally provided driving integrated circuit (IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The bus electrodes 16' and 17' are formed of a three-layered thin film of Cr—Cu—Cr. At this time, the bus electrodes 16' and 17' have a line width of ⅓ of a line width of the transparent electrodes 16 and 17.

The operation of the aforementioned AC type plasma display panel of three-electrode area discharge type will be described with reference to FIGS. 3*a* to 3*d*.

If a driving voltage is applied between each address electrode and each scan electrode, opposite discharge occurs between the address electrode and the scan electrode as shown in FIG. 3*a*. The inert gas injected into the discharge cell is instantaneously excited by the opposite discharge. If the inert gas is again transited to the ground state, ions are generated. The generated ions or some electrons of quasi-excited state come into collision with a surface of the passivation film as shown in FIG. 3*b*. The collision of the electrons secondarily discharges electrons from the surface of the passivation film. The secondarily discharged electrons come into collision with a plasma gas to diffuse the discharge. If the opposite discharge between the address electrode and the scan electrode ends, wall charges having opposite polarities occur on the surface of the passivation film on the respective address electrode and the scan electrode, as shown in FIG. 3*c*.

If the discharge voltages having opposite polarities are continuously applied to the scan electrode and the sustain electrode and at the same time the driving voltage applied to the address electrode is cut off, area discharge occurs in a discharge region on the surfaces of the dielectric layer and the passivation film due to potential difference between the scan electrode and the sustain electrode as shown in FIG. 3*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrode and the barrier so that the phosphors are excited. The excited phosphors generate visible light rays, and the visible light rays display an image on a screen. That is, the plasma display panel is operated.

A related art plasma display panel of two-electrode area discharge type will be described with reference to FIG. 4.

Opposite discharge occurring between a pair of electrodes formed to face each other on facing substrates is controlled to display an image.

The plasma display panel of two-electrode area discharge type includes electrodes in a matrix arrangement. That is, this plasma display panel includes a plurality of cathodes 50 formed on a lower substrate, a plurality of display anode electrodes 60 formed on an upper substrate to be orthogonal to the cathode electrodes, and a plurality of auxiliary anode electrodes 70.

The cathode electrodes 50 are separated from the anode electrodes 60 and 70 by barriers 23. A space of a display charge cell 80 and a space of an auxiliary discharge cell 80' are respectively formed. A space having a certain area is formed between most of the barriers 23 and the upper substrate 10 and between most of the barriers 23 and the lower substrate 20, so that a priming path is formed. The priming path induces auxiliary discharge generated by the auxiliary discharge cell 80' to the display discharge cell 80.

The aforementioned plasma display panel adopts a pulse memory system. A method for driving the pulse memory system will now be described.

As shown in FIG. 5, a sustain discharge pulse 90 is always applied to the cathode electrodes and a scan pulse 95 is applied from the first cathode electrode to the next cathode electrode in turn. At this time, auxiliary discharge occurs whenever the scan pulse 95' is applied to the auxiliary discharge cell 80'.

The discharge of the auxiliary discharge cell 80' is successively spread into an adjacent auxiliary discharge cell, thereby generating charge particles. The charge particles are spread into the adjacent display discharge cell 80 through the priming path. Thus, delay time required to discharge the display discharge cell is reduced.

A data pulse 93 is applied to the display anode electrode 60 when the scan pulse 95 is applied to the cathode electrode 50. Since a discharge voltage of the display discharge cell 80 is lowered by the auxiliary discharge for generating display discharge, once addressed cell sustains discharge by applying the sustain discharge pulse 90 thereto.

However, the related art plasma display panel of two-electrode area discharge type has problems that each electrode is degraded and service life of the phosphors is reduced due to opposite discharge. The related art plasma display panel of three-electrode area discharge type has problems that aperture ratio and discharge efficiency are lower than those of the plasma display panel of two-electrode area discharge type.

SUMMARY OF THE INVENTION

Accordingly, the present invention is directed to a structure and driving method for a plasma display panel that substantially obviates one or more of the problems due to limitations and disadvantages of the related art.

An object of the present invention is to provide a structure and driving method for a plasma display panel in which degradation of electrodes is reduced and service-life reduction of phosphors is minimized.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a structure for a plasma display panel according to the present invention includes a plurality of upper electrodes formed on an upper substrate at certain intervals in one direction, a dielectric layer formed on the upper substrate including the upper electrodes, an auxiliary electrode formed on the dielectric layer between adjacent upper electrodes, a passivation film formed on the dielectric layer including the auxiliary electrode, a lower electrode formed on a lower substrate opposite to the upper electrodes to be orthogonal to the upper electrodes, and a dielectric layer formed on the lower substrate including the lower electrode.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

A structure of a plasma display panel according to the present invention will be described with reference to FIG. 6.

Figure 1A:
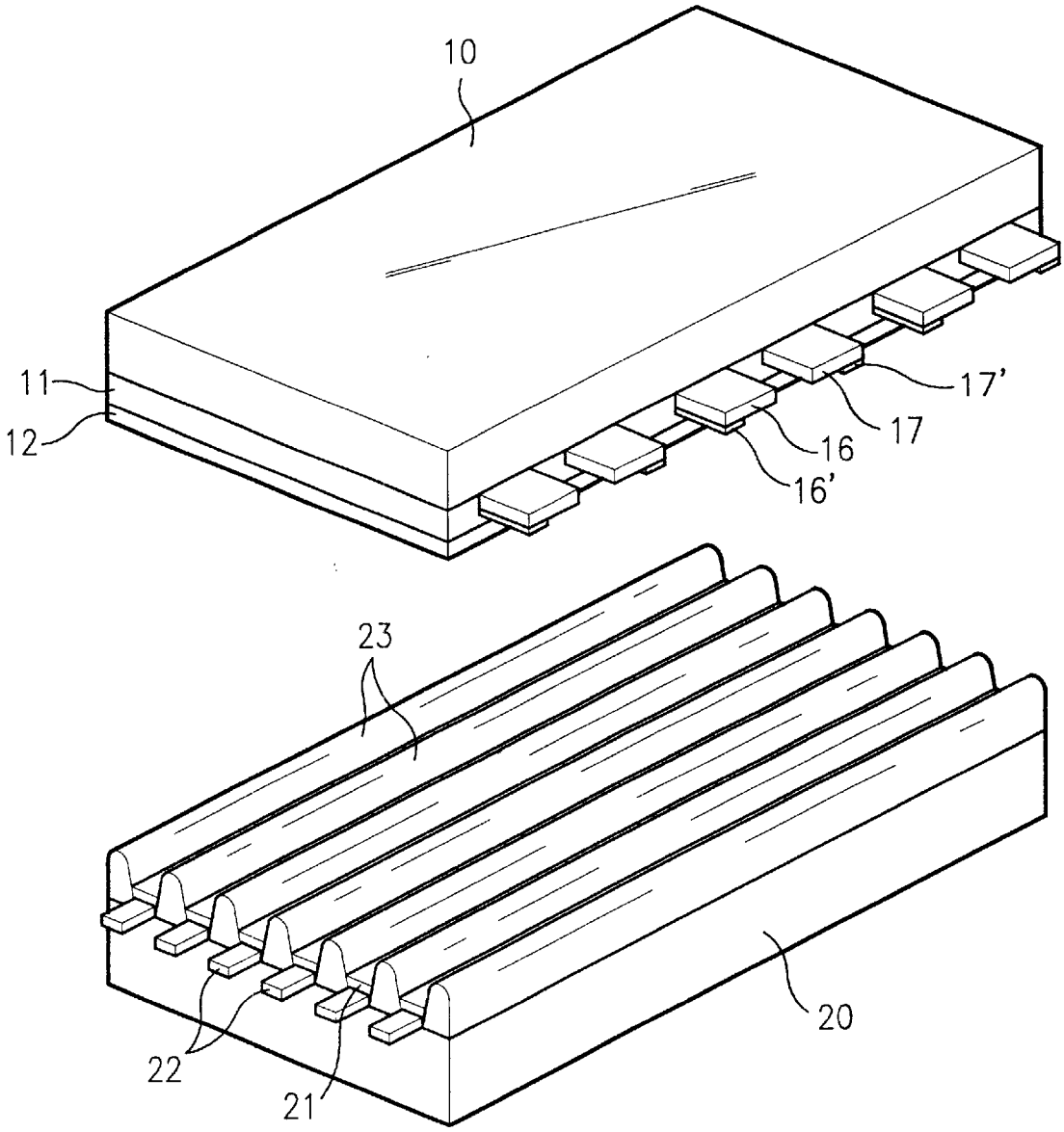
FIG. 1A Related Art
FIGS. 1*a* and 1*b* show a structure of a plasma display panel of three-electrode area discharge type.
Figure 1B:
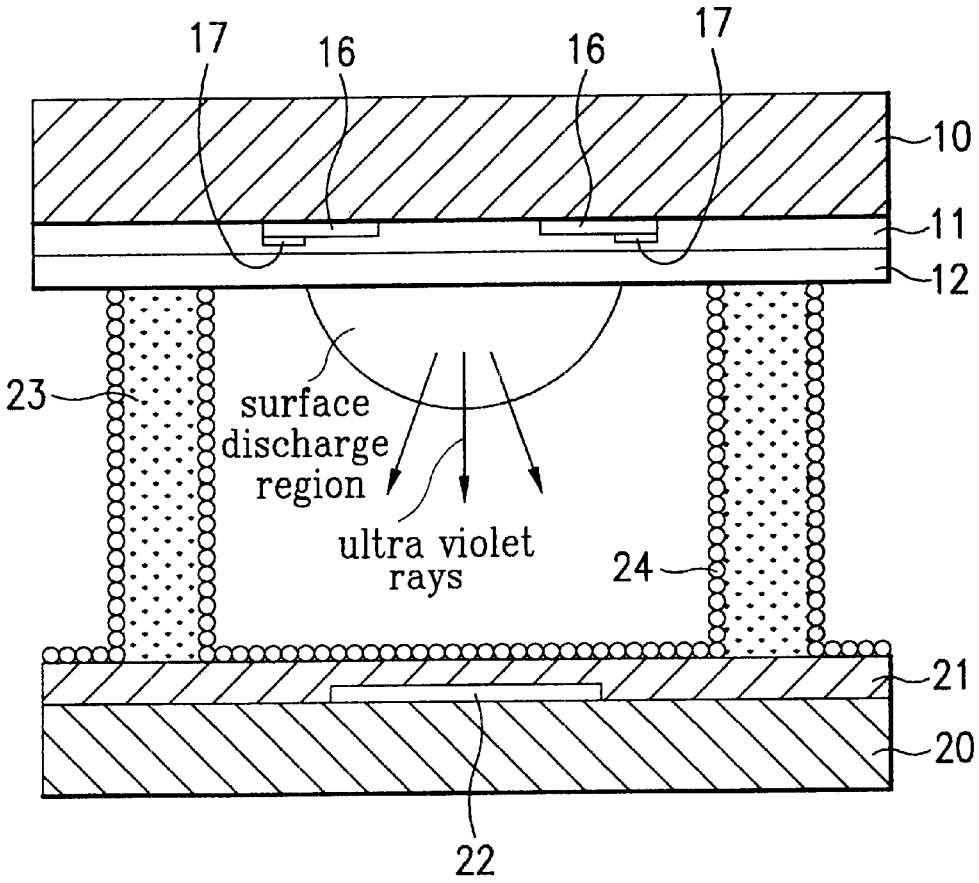
FIG. 1B Related Art
Figure 2A:
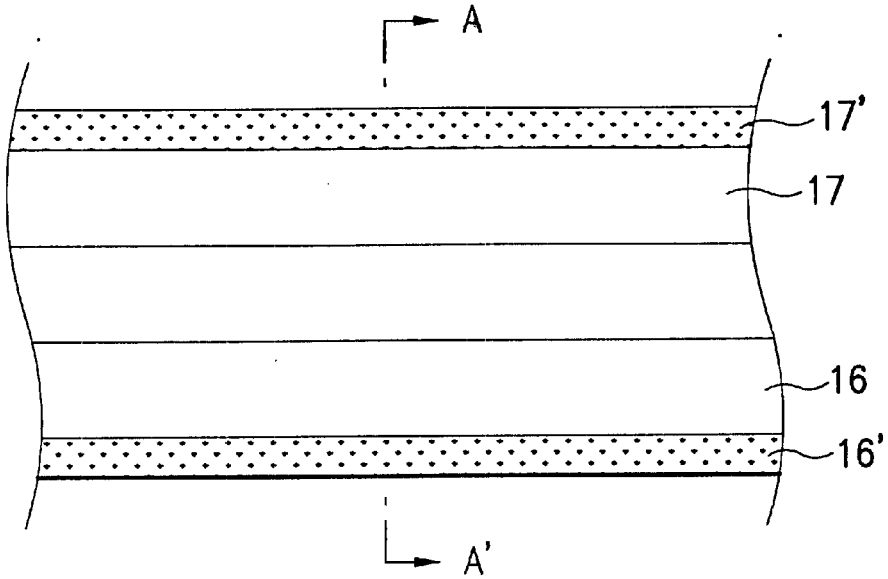
FIG. 2A Related Art
FIGS. 2*a* and 2*b* show a structure of a sustain electrode of the plasma display panel of three-electrode area discharge type.
Figure 2B:
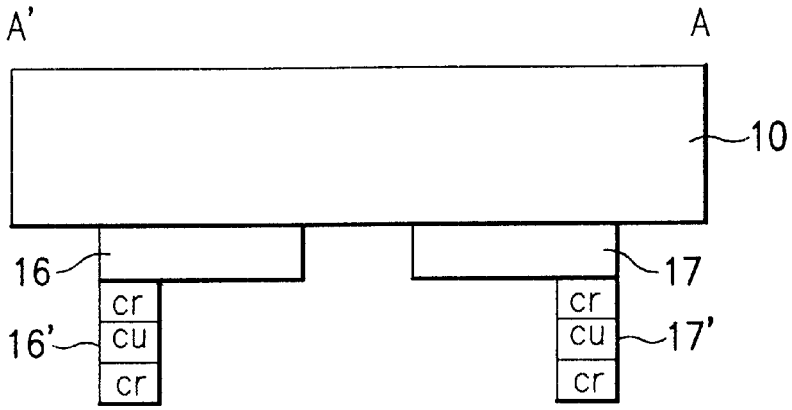
FIG. 2B Related Art
Figure 3A:
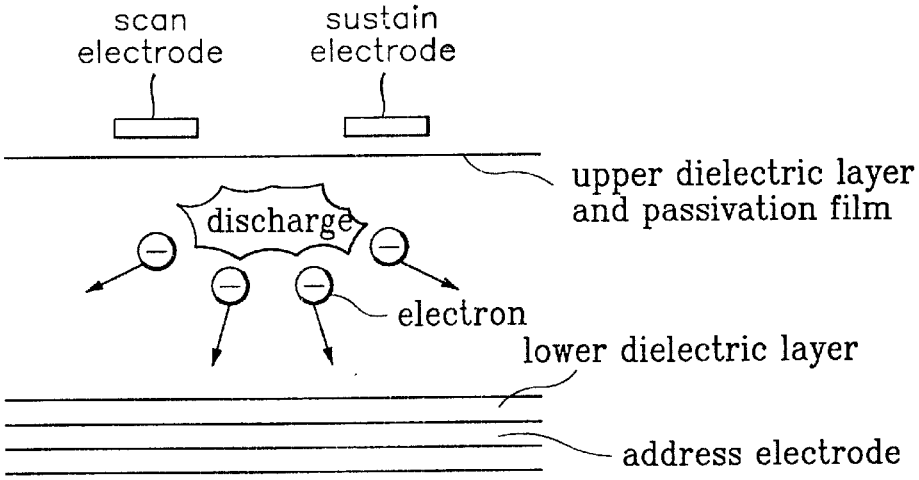
FIG. 3A Related Art
FIGS. 3*a* to 3*d* show an operation of a discharge cell of the plasma display panel of three-electrode discharge type.
Figure 3B:
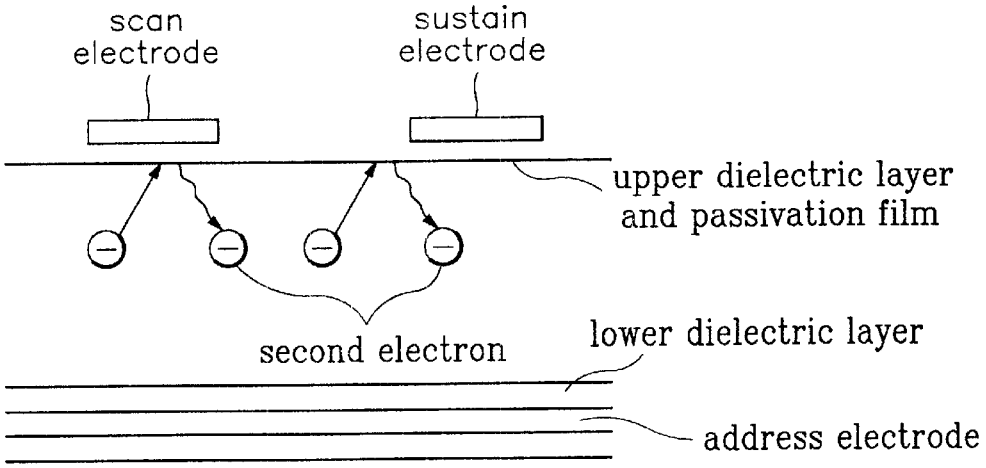
FIG. 3B Related Art
Figure 3C:
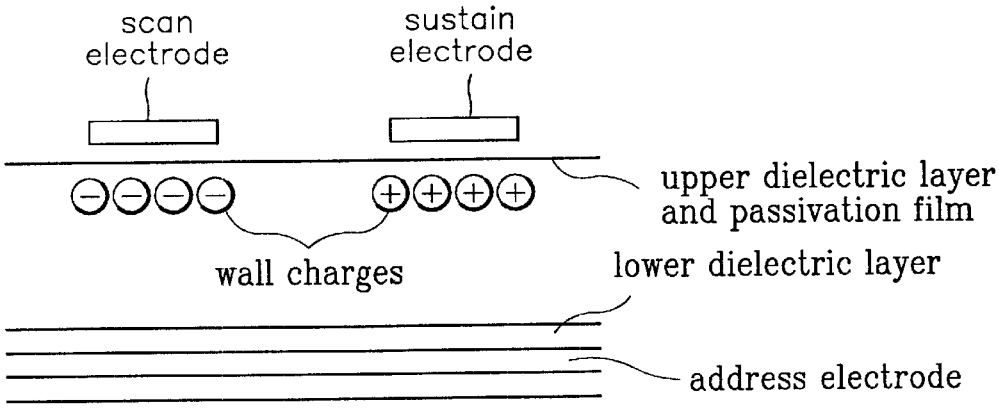
FIG. 3C Related Art
Figure 3D:
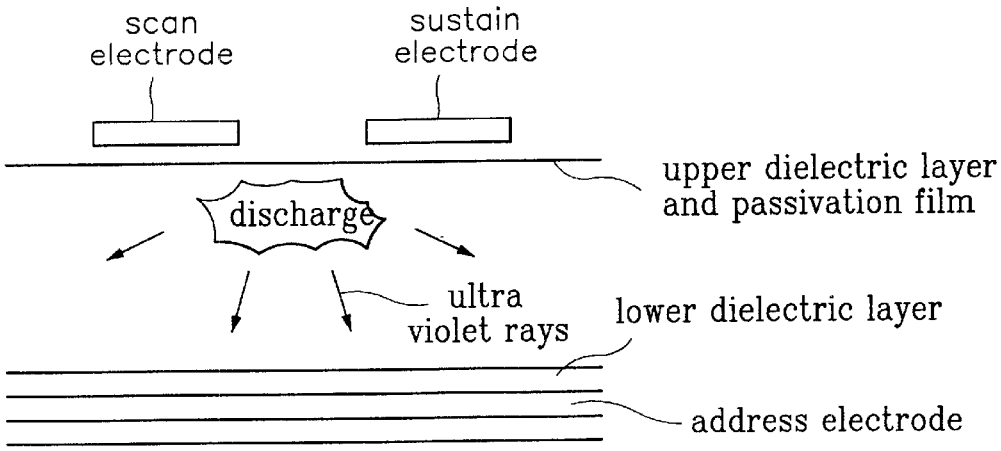
FIG. 3D Related Art
Figure 4:
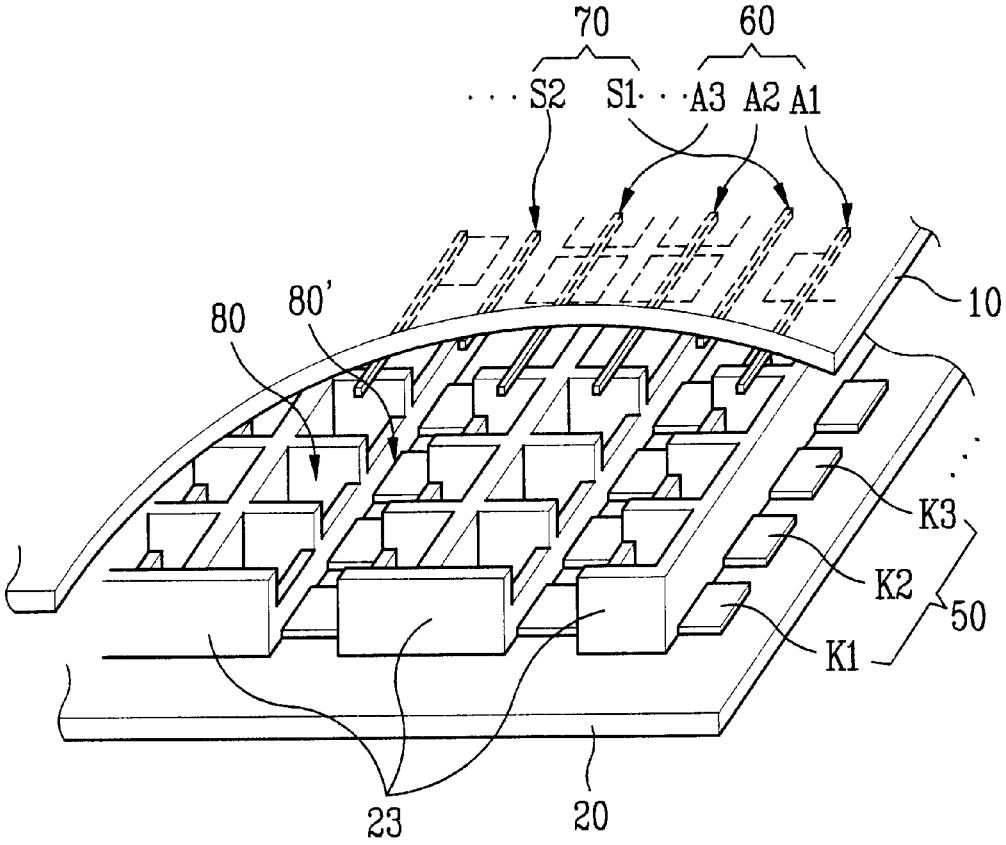
FIG. 4 Related Art
FIG. 4 shows a structure of a plasma display panel of two-electrode area discharge type.
Figure 5:
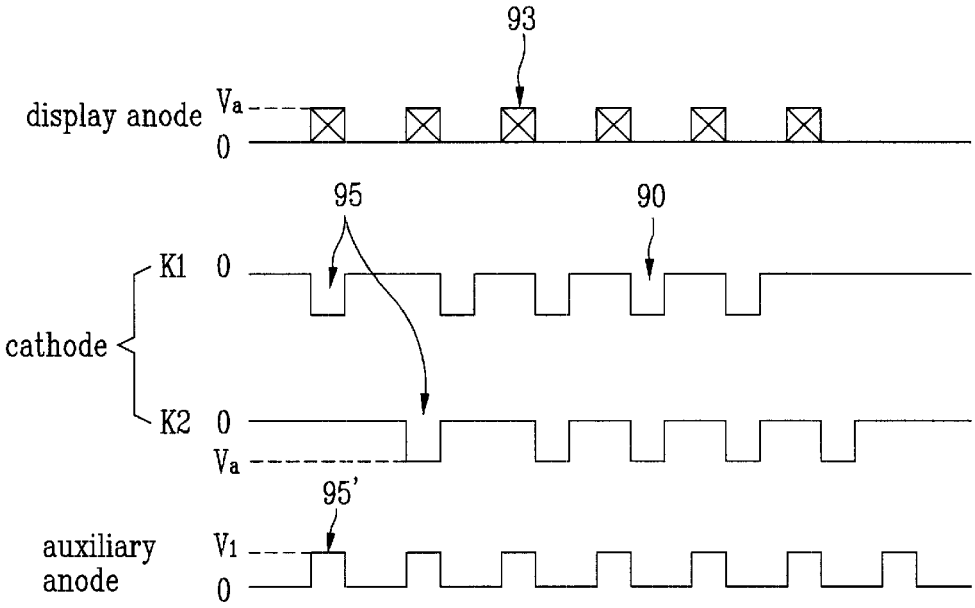
FIG. 5 Related Art
FIG. 5 is a timing chart showing a driving pulse waveform of FIG. 4.
Figure 6:
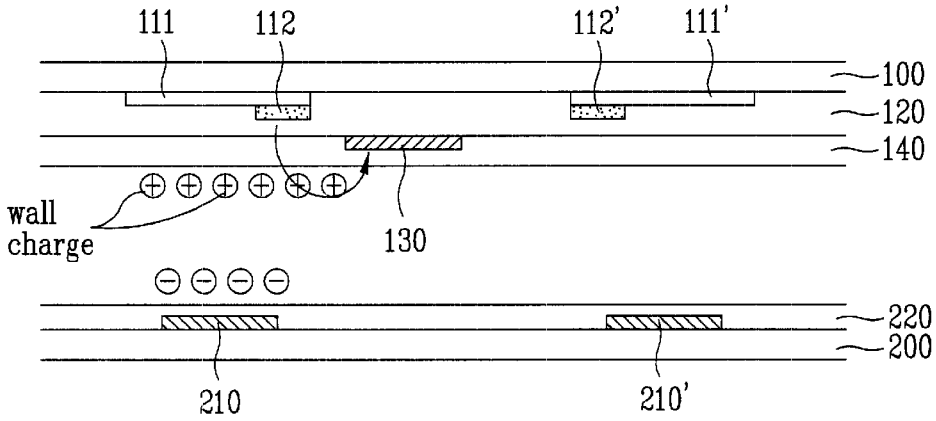
FIG. 6 shows a structure of a plasma display panel according to the present invention.

As shown in FIG. 6, the plasma display panel of the present invention includes a plurality of upper electrodes 111 and 112 formed on an upper substrate 100, a dielectric layer 120 formed on the upper substrate 100 including the upper electrodes 111 and 112, an auxiliary electrode 130 formed on the dielectric layer 120 between the upper electrodes 111 and 112 and their adjacent upper electrodes 111' and 112', a passivation film 140 formed on the dielectric layer 120 including the auxiliary electrode 130, a lower electrode 210 formed on a lower substrate 200 opposite to the upper electrodes 111 and 112 to be orthogonal to the upper electrodes 111 and 112, and a dielectric layer 220 formed on the lower substrate 200 including the lower electrode 210.

In FIG. 6, the lower substrate 200 in which the lower electrode 210 is formed is rotated by 90°.

The upper electrodes includes a transparent electrode 111 and a bus electrode 112 having a smaller width than the transparent electrode 111, in the same manner as the related art plasma display panel.

The auxiliary electrode 130 is not formed on the same layer as the upper electrodes 111 and 112 but formed on the dielectric layer 120. Preferably, the auxiliary electrode 130 has a width smaller than an overall width of the upper electrodes 111 and 112.

A driving method for a plasma display panel according to the present invention will be described with reference to FIG. 7 to FIG. 9.

The driving method for a plasma display panel according to the present invention is characterized in that two opposite electrodes are arranged to cross each other in a matrix arrangement, so that discharge occurs by a first pulse applied to one of the electrodes and a second pulse is applied to other electrode within 1 $\mu$s from the time when the first pulse is applied. The driving method for a plasma display panel according to the present invention is also characterized in that Townsend discharge is used.

Particularly, the first pulse applied to the one electrode has a certain high period and low period, and the second pulse applied to the other electrode has a width different from the first pulse. At this time, after the first pulse is turned on, it is preferable that the second pulse is turned on before the first pulse is turned off. The first pulse may be turned off and at the same time the second pulse may be turned on. Further, after the first pulse is turned off, the second pulse may be turned on after a predetermined time difference.

In the driving method for the plasma display panel, an erasing pulse is applied to each electrode to erase positive wall charges during a sustain discharge period.

Figure 7:
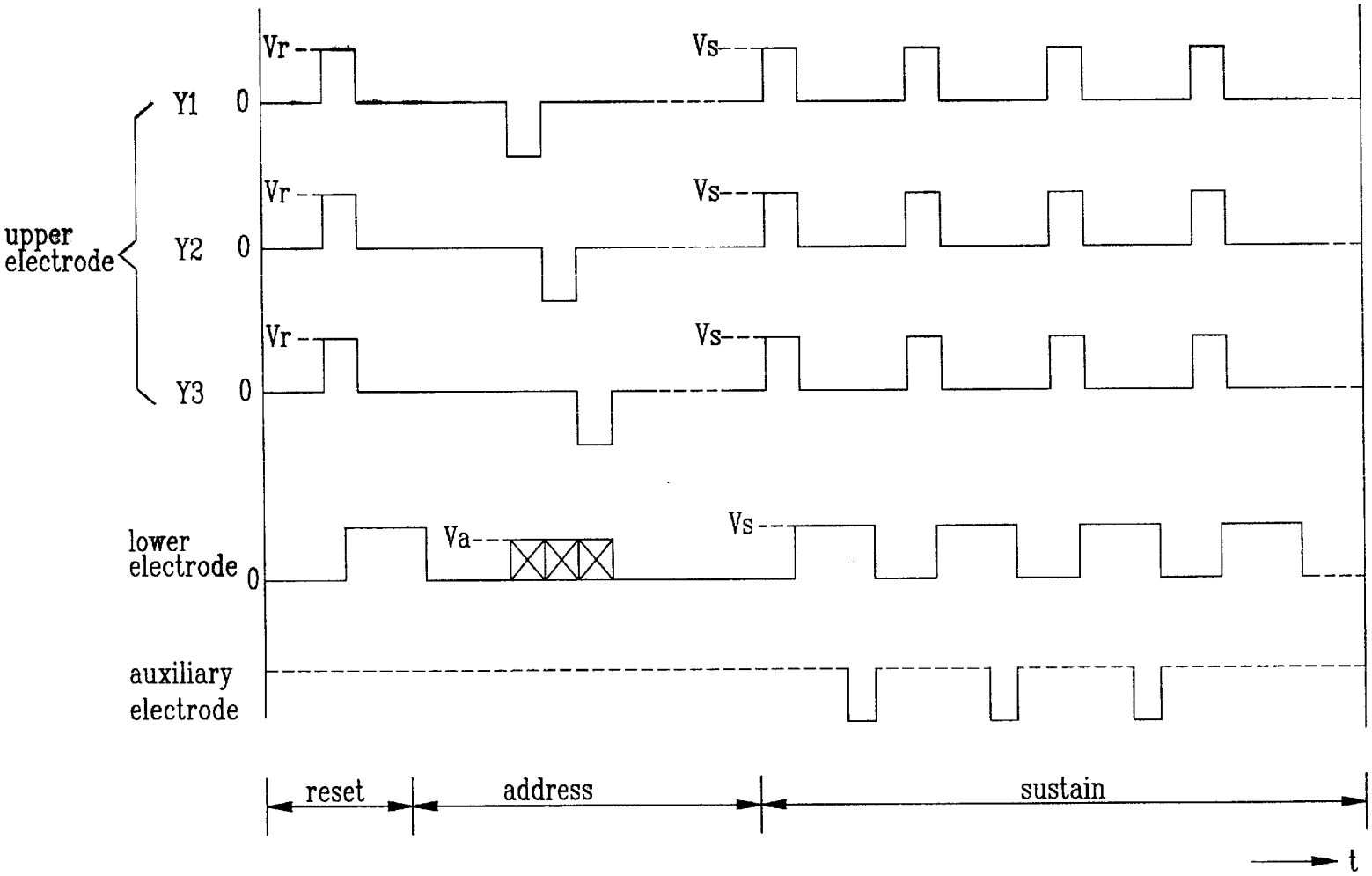
FIG. 7 is a timing chart showing a driving pulse of a plasma display panel according to the present invention.

As shown in FIG. 7, a scan pulse of a negative voltage is applied to the upper electrodes 111 and 112 during an address period and a data pulse of a positive voltage is applied to the lower electrode 210. Thus, wall charges are formed on the passivation film 140 of the upper substrate 100 and the dielectric layer 220 of the lower substrate 200.

If the-wall charges are formed on the passivation film 140, a certain electric field is maintained between the lower electrode 210 and the upper electrodes 111 and 112. The electric field causes priming effect in which a discharge start voltage between the lower electrode 210 and the upper electrodes 111 and 112 becomes lower than a case where wall charges are not formed.

Figure 8:
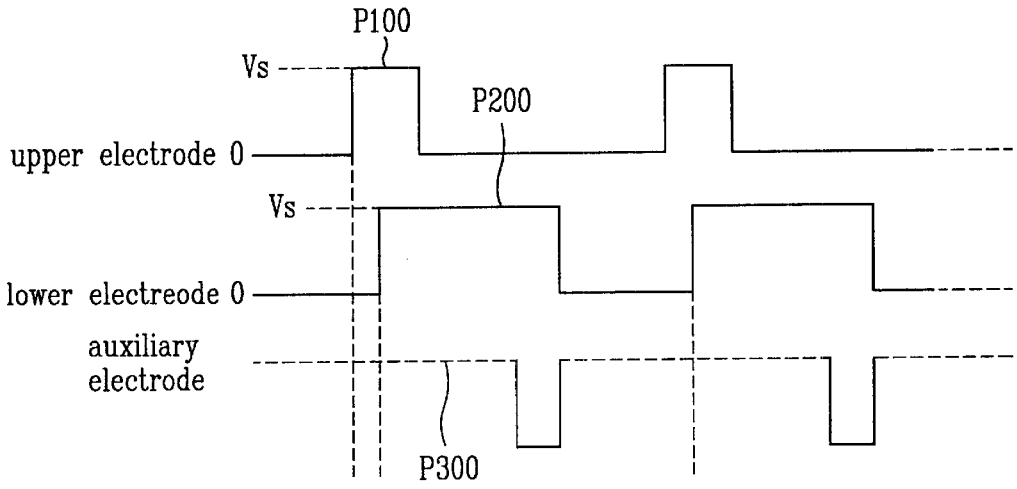
FIG. 8 shows a driving pulse of a sustain period of FIG. 7.

After the address period is ended, a pulse such as (a) of FIG. 8 is applied to the upper electrodes 111 and 112 during the sustain period, thereby generating discharge. If a pulse such as (b) of FIG. 8 is applied to the lower electrode 210 before the generated discharge is ended, a positive ion is formed on the upper electrodes 111 and 112 and a negative wall charges are formed on the lower electrode 210.

Thereafter, before the pulse applied to the lower electrode 210 is turned off, or after the pulse applied to the lower electrode 210 is turned off, or when the pulse applied to the lower electrode 210 is turned off, if a pulse is applied to the auxiliary electrode 130 of a floating state, as shown in (c) of FIG. 8, discharge occurs between the upper electrodes 111 and 112 and the auxiliary electrode 130. As a result, the ion on the upper electrodes 111 and 112 comes into collision with a surface of the passivation film. The ion is erased by a secondary electron discharged from the passivation film.

At this time, the auxiliary electrode 130 maintains an electrically opened floating state during a reset period and the address period. The auxiliary electrode 130 also maintains the floating state during the sustain period except for the period to which a pulse is applied.

Therefore, the ion is erased by the operation of the auxiliary electrode 130. This prevents sputtering of the lower electrode 210 and the phosphors from occurring due to the ion, thereby preventing the phosphors, the lower electrode 210 and the dielectric layer 220 from being degraded.

Consequently, when one sustain period has been ended, the negative wall charges on the dielectric layer 220 of the lower substrate 200 remain only. During the next sustain period, priming effect is sustained by the remaining negative wall charges on the lower substrate 200. The priming effect supports discharge of the next sustain period to sustain the operation of the plasma display panel.

The principle of performing Townsend discharge of the plasma display panel will be described below.

Figure 9:
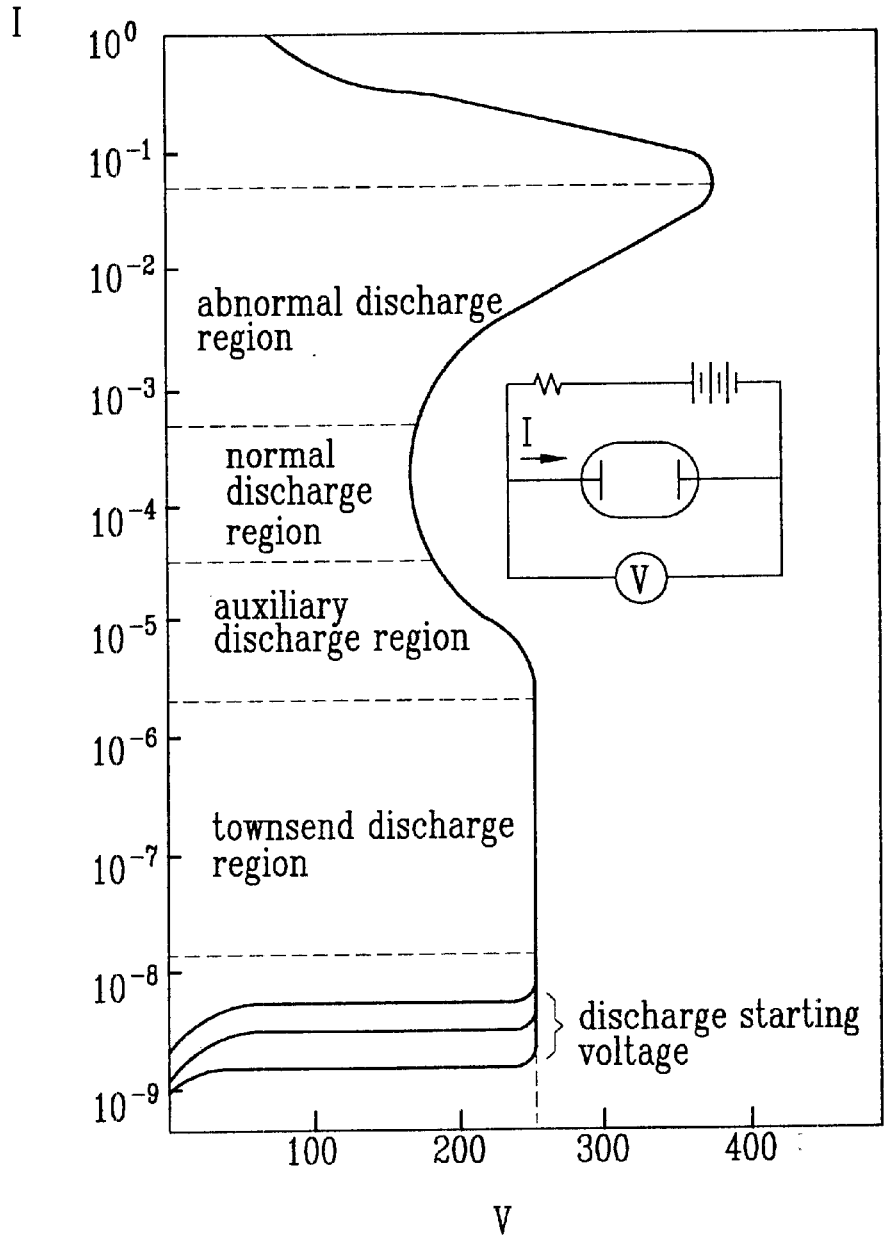
FIG. 9 is a graph showing characteristic of a voltage and a current due to discharge of the plasma display panel according to the present invention.

Discharge voltage/current characteristic of the plasma display panel is as shown in FIG. 9.

If a voltage at both ends of an electrode ascends, current rapidly increases for a certain period. If a voltage reaches a predetermined level, the amount of current is rapidly reduced at a certain level. Thus, the amount of current does not increase any longer. At this time, a region where the amount of current does not increase any longer is a normal discharge region, and a region where the amount of current rapidly increases is a Townsend discharge region.

In the plasma display panel of the present invention, as shown in FIG. 8, discharge occurs by a high voltage of the first pulse P100 applied to the upper electrodes 111 and 112. Subsequently, the voltage of the first pulse P100 is offset by the voltage of the second pulse P200 applied to the lower electrode 210. Thus, the discharge is ended. That is to say, discharge occurs for a short time period between the time when the first pulse P100 is turned on and the time when the second pulse P200 is turned on.

Accordingly, a high voltage is instantaneously applied between the upper electrodes 111 and 112 and the lower electrode 210 so that Townsend discharge occurs for a short time.

While the voltage of the second pulse P200 is applied to the lower electrode 210, the first pulse P100 is turned off. The second pulse is turned off and at the same time the third pulse is turned off for a short time and turned on again.

As a result, by the second and third pulses P200 and P300 having different phases, the positive ion and the negative electron move between the lower electrode 210 to which the second pulse P200 is applied and the auxiliary electrode 130 to which the third pulse P300 is applied. Thus, the wall charges are generated on the passivation film 140 on the lower electrode 210, thereby generating priming effect for sustain discharge.

Afterwards, if the first pulse P100 is applied to the upper electrodes 111 and 112 by the priming effect, Townsend discharge occurs again between the lower electrode 210 and the upper electrodes 111 and 112.

As aforementioned, the plasma display panel of the present invention has the following advantages.

Unlike the related art plasma display panel, sputtering of the lower electrode and the phosphors is prevented from occurring, so that the phosphors, the electrodes and the dielectric layer are prevented from being degraded, thereby causing Townsend discharge in the discharge cell. This increases service life of the plasma display panel and reduces discharge power consumption, thereby improving discharge efficiency.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A structure for a plasma display panel, comprising:

a plurality of upper electrodes formed on an upper substrate at intervals in one direction;

a dielectric layer formed on the upper substrate including over the upper electrodes;

an auxiliary electrode formed on the dielectric layer between adjacent upper electrodes;

a passivation film formed on the dielectric layer including over the auxiliary electrode;

a lower electrode formed on a lower substrate opposite to the upper electrodes to be orthogonal to the upper electrodes; and a dielectric layer formed on the lower substrate including the lower electrode.

2. The structure for a plasma display panel as claimed in claim 1, wherein the auxiliary electrode has a smaller width than that of the upper electrodes.

3. The structure for a plasma display panel as claimed in claim 1, wherein the respective upper electrode includes a transparent electrode, and a metal electrode formed on the transparent electrode at a smaller width than the transparent electrode.

4. A driving method for a flat panel display device in which two opposite electrodes are arranged to cross each other in a matrix arrangement, the driving method for a plasma display panel comprising:

generating discharge by a first pulse applied to one electrode of the electrodes; and applying a second pulse to the other electrode within 1 $\mu$s from the time when the first pulse is applied to the one electrode.

5. The driving method for a plasma display panel as claimed in claim 4, wherein the first pulse applied to the one electrode has a certain high period and low period.

6. The driving method for a plasma display panel as claimed in claim 4, wherein the second pulse applied to the other electrode has a width different from the first pulse.

7. The driving method for a plasma display panel as claimed in claim 4, wherein the second pulse applied to the other electrode has a width greater than the first pulse.

8. The driving method for a plasma display panel as claimed in claim 4, wherein after the first pulse applied to the one electrode is turned on, the second pulse is applied to the other electrode before the first pulse is turned off.

9. The driving method for a plasma display panel as claimed in claim 4, wherein after the first pulse applied to the one electrode is turned on, the second pulse is applied to the other electrode when the first pulse is turned off.

10. The driving method for a plasma display panel as claimed in claim 4, wherein after the first pulse applied to the one electrode is turned on, the second pulse is applied to the other electrode with a predetermined time difference after the first pulse applied to the one electrode is turned off.

11. A driving method for a flat panel display device in which two opposite electrodes are arranged to cross each other in a matrix arrangement, the flat panel display device having an auxiliary electrode for erasing wall charges generated by discharge of the two electrodes, the driving method for a plasma display panel comprising:

generating discharge by a first pulse applied to one electrode of the two electrodes;

applying a second pulse to the other electrode within 1 $\mu$s from the time when the first pulse is applied to the one electrode; and applying an erasing pulse to the auxiliary electrode during a sustain discharge period, the erasing pulse erasing anode wall charges of the wall charges formed by discharge.

12. The driving method for a plasma display panel as claimed in claim 11, wherein the erasing pulse is applied to the auxiliary electrode before the second pulse is ended.

13. The driving method for a plasma display panel as claimed in claim 11, wherein the erasing pulse is applied to the auxiliary electrode when the second pulse is ended.

14. The driving method for a plasma display panel as claimed in claim 11, wherein the erasing pulse is applied to the auxiliary electrode with a predetermined time difference after the second pulse is ended.

15. The driving method for a plasma display panel as claimed in claim 11, wherein the auxiliary electrode is electrically floating during a reset period and an address period.

16. A driving method for a plasma display panel, comprising:

generating discharge by a first pulse applied to one electrode of opposite electrodes; and applying a second pulse to the other electrode within a predetermined time period from the time when the first pulse is applied to the one electrode, wherein at least one of an erasing pulse is applied to an auxiliary electrode before the second pulse is ended, an erasing pulse is applied to an auxiliary electrode when the second pulse is ended, and an erasing pulse is applied to an auxiliary electrode with a predetermined time difference after the second pulse is ended.

17. The driving method for a plasma display panel as claimed in claim 16, wherein the auxiliary electrode is electrically floating during a reset period and an address period.

* * * * *